United States Patent [19]

Daudi

[11] Patent Number: 4,606,206

[45] Date of Patent: Aug. 19, 1986

[54] METHOD AND APPARATUS FOR EDGE PREPARATION OF SPINNING BLANKS

[75] Inventor: Anwar R. Daudi, E. Lansing, Mich.

[73] Assignee: Motor Wheel Corporation, Lasning, Mich.

[21] Appl. No.: 696,335

[22] Filed: Jan. 30, 1985

[51] Int. Cl.[4] ..... B21D 22/18

[52] U.S. Cl. ..... 72/68; 72/83

[58] Field of Search ..... 72/68, 82, 83

[56] References Cited

U.S. PATENT DOCUMENTS 1,671,994 6/1928 Nelson ..... 72/83

3,738,139 6/1973 Proops et al. ..... 72/69

*Primary Examiner*—Lowell A. Larson

*Attorney, Agent, or Firm*—Barnes, Kisselle, Raisch, Choate, Whittemore & Hulbert

[57] ABSTRACT

Method and apparatus for forming an annular article from a circular blank. The blank is held in a rotatable chuck such that a peripheral portion of the blank is spaced from the chuck while rotated about an axis of revolution thereof. A work roller edge conditions the peripheral blank portion by engagement therewith under sufficient force and for a sufficient cycle time to impart an upset condition thereto. The blank edge surface is smoothed and hardened by the work roller to a given rounded curvature in radial cross section and a controlled thickness increase is obtained in the blank peripheral portion, the maximum thickness occurring at the rounded curvature edge surface. The work roller has an external circumferential groove with an entrance wider axially of the roller than the starting axial dimension of said peripheral portion of said blank. The roller is moved in a direction perpendicular to its rotational axis with the roller groove centered on the blank edge. The roller groove has a rounded root surface with a radius of curvature slightly greater than the axial starting thickness of the engaged edge of said blank, the thickness contour increase being terminated when said upset peripheral portion bottoms in said roller groove. Thereafter the peripheral blank portion is draw spun with a first spinning roller while spaced from the mandrel surface so as to reduce the thickness contour of said peripheral portion to said preselected thickness contour. The edge work roller and first spin roller are both fixedly mounted on a common tool slide and juxtaposed relative to one another and the starting position of the blank when so chucked such that the rollers have mutually non-interferring travel paths relative to the blank throughout the respective work cycle motions of the rollers.

14 Claims, 8 Drawing Figures

105
104
108
100
106
103
102
108
100
80
78
70
74
82
76
72
F
38
18
36
34
22
24
28
26
20
12
14
30
32
10
16

42
CONTROL 40
45
43
46
44
47
38
10
12
20
G
18
16
49

METHOD AND APPARATUS FOR EDGE PREPARATION OF SPINNING BLANKS

The present invention relates to the manufacture of vehicle wheel parts, and more particularly to a method and apparatus for conditioning the edges of sheet metal blanks preparatory to spin-forming the same into wheel parts such as integral rim and disc segments.

It is conventional in the art to form vehicle wheel discs by draw spinning a circular disc blank against an internal mandrel having the desired disc cross sectional contour. One example of such prior art is the method and apparatus shown in the U.S. Bulgrin et al. U.S. Pat. No. 3,143,377, which is directed to shear spinning of a truck wheel disc.

A recently developed method and apparatus for spin forming integral rim and disc segments is set forth in a copending U.S. patent application Ser. No. 06/596,143, filed Apr. 2, 1984 (now Pat. No. 4,554,810 granted Nov. 26, 1985) in the name of Kevin D. Jurus and assigned to the assignee herein. In this improvement a circular blank of uniform stock thickness is first fixed with its central portion clamped coaxially in a spinning chuck. The spinning chuck includes a mandrel having an outer surface which corresponds to the desired final geometric interior contour of the rim and disc segment, and the periphery (i.e., the outward annular boundary region of the segment as distinguished from its internal region or center) of the blank is angled slightly over the mandrel surface, but projects radially outwardly therefrom so as to be spaced axially and radially therefrom. The periphery of the circular blank is then subjected to a draw spinning operation wherein a first spinning roller is cycled through a number of passes across the blank periphery while the blank is spun by the chuck. During each pass, axial and radial motion of the roller is so controlled as to draw and thin the blank stock while the periphery is spaced from and unsupported by the mandrel surface. After a number of such controlled passes, the stock thickness of the blank periphery is substantially reduced as compared to the starting thickness, and preferably is of substantially uniform thickness. Upon completion of the draw spinning operation, the blank periphery is disposed closely adjacent to, but is still unsupported by, the mandrel surface.

Forming of the wheel rim and disc segment is then completed in a spin-forming operation wherein a second roller is passed over the workpiece so as to form the blank periphery against, and thus at least its interior surface, to the shape of the mandrel surface without appreciably altering the thickness thereof. The result is a wheel segment with a disc portion having the original blank thickness in contour, and an integral rim segment portion having a reduced, substantially uniform thickness contour obtained during the draw spinning operation wherein the drawn portion of the workpiece was spaced from and unsupported by the mandrel surface, and a geometric contour obtained by forming the draw-spun blank periphery against the mandrel surface.

One well-known problem encountered in such prior art processes arises from the fact that the cut edges of any plate (high strength steel, in particular) are subject to cracking during cold forming, which is cause for rejection of the workpiece. When the steel blanks are sheared to cut the blank to starting size and shape, the edges are rough and often have surface cracks. If gas cutting is employed for cutting of the blank, smoother edges are usually produced, but frequently the edges of gas-cut steel plate will be hardened in cooling from the cutting temperature. Thus, from either method of cutting, nucleation sites for cracks are likely to be present. The danger from cracking caused by rough edges increases as sheet or plate thickness increases and the finished diameter of the cylinder decreases. Because the plate surface that forms the outside diameter is in tension during forming, cracks propagate from edges, which are in tension.

Accordingly, in such prior art forming processes the design of the starting blank required to form a given shape customarily included provision for a relatively large margin scrap area around the outer periphery of the blank. The blank was thus made diametrically oversize in order to provide an "isolation" zone around the margin of the blank outer periphery to allow enough metal in which stress crack migration could occur radially inwardly from the outer edge of the blank without reaching the outer dimension of the ultimate finished part. Upon completion of the spinning operation of the blank, this outer marginal isolation material area was machined off and discarded as scrap. In addition to leaving stress cracks isolation material zones around the blank, it is also customary to machine the edges before cold forming. Typically the machining provides a slight bevel on the critical edges of the blank to further reduce nucleation sites for cracks. However, the aforementioned blank sizing and edge preparation steps prior to cold forming have represented a significant cost of processing in terms of scrap loss, machining time and/or equipment required preparatory to cold forming of the blank.

Accordingly, it is the general object of the present invention to provide an improved method and apparatus for edge preparation of spin-forming blanks which results in a considerable reduction in scrap loss and a substantial saving in machining time and equipment, while also reducing the danger of crack initiation at and/or migration from, the edges into the workpiece, despite the same being subjected to the severe cold forming stresses encountered in draw spinning.

The invention, together with additional objects, features and advantages thereof, will be best understood from the following detailed description taken in conjunction with the accompanying appended claims and drawings, in which:

FIG. 1 is a fragmentary central axial and radial sectional view of a preformed starting blank clamped in the mandrel of a spin-forming machine before the operation of one exemplary, but preferred, embodiment of an edge conditioning apparatus, and performance of the method in accordance with the present invention, an edge conditioning roller of the invention being juxtaposed to the blank of the same preparatory to subsequent spin forming into an integral rim and disc segment for a vehicle wheel;

Figures 1, 7, 8:
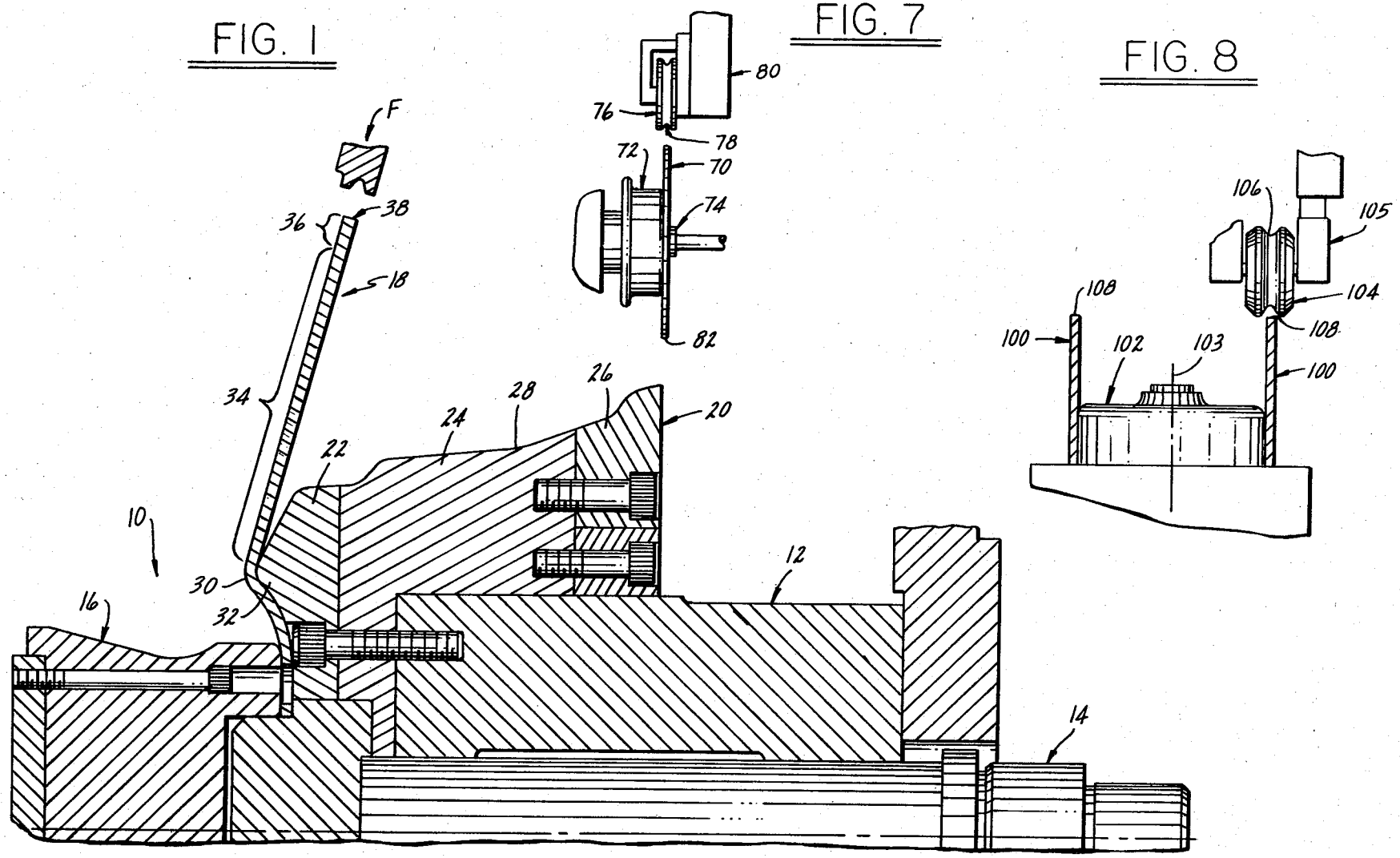

FIG. 7 is a simplified schematic view of another embodiment of the method and apparatus of the present invention employed for edge conditioning of flat discs to be spun form into truck wheel discs; and FIG. 8 is a simplified schematic view of still another embodiment of method and apparatus of the present invention adapted for blank edge conditioning of a cylindrical hoop prior to forming the same into a wheel part.

In the following description and claims, directional adjectives such as "inboard", "outboard" and "outward" are used by way of description and not by way of limitation, and are taken with reference to preferred orientation of the invention illustrated in the drawings, and no undue limitation should be inferred from such directional descriptions non-essential to operation of the structural and functional features of the invention.

FIG. 1 illustrates a spinning chuck 10 which includes a head stock 12 mounted on a drive shaft 14. A tail stock 16 is movable axially with respect to head stock 12 so as to clamp a workpiece blank 18 therebetween, and is rotatably conjointly with head stock 12 powered by drive shaft 14. A mandrel 20 is mounted on head stock 12. In the embodiment illustrated in FIG. 1, mandrel 20 comprises three mandrel segments 22,24,26 which are assembled to each other so as to define an axially and radially outwardly facing mandrel surface 28 which corresponds to the desired inboard interior geometric contour of an integral rim and disc segment to be formed in accordance with the disclosure and claims of the aforementioned co-pending Jurus application Ser. No. 06/596,143, filed Apr. 2, 1984, which is incorporated herein by reference.

As set forth in more detail in said Jurus application, a preformed circular blank 18 is first mounted on head stock 12 and the central portion of blank 18 is clamped thereagainst by tail stock 16 for coaxial rotation therewith. Blank 18, in the preferred implementation of the present invention as well as in the invention of the aforesaid Jurus application, is preformed in a blanking and bending operation from sheet stock and possesses a substantially uniform thickness throughout, for example, 0.205". Most preferably, blank 18 is constructed of grade SAE 945 high strength, low alloy steel composition. It is preferred to preform blank 18 to possess an outward bend 30 which will fit over the nose 32 of the mandrel segment 22.

As indicated in FIG. 1, an annular zone 34 of blank 18, which constitutes the major portion of blank 18 and is in the form of a frustonconical shape, extends axially and radially outwardly from bend 30 at a slight angle with respect to the radius of the axis of rotation of chuck 10 and at an acute angle with respect to the surface 28 or mandrel 20. Blank 18 also has an outer peripheral marginal zone 36 which is an integral extension of zone 34 and which defines the outer peripheral edge 38 of blank 18. Zone 34 of blank 18 represents that portion of the blank which will be severely cold worked by the drawspinning method of the aforesaid Jurus application, whereas the marginal zone 36 of blank 18, which will become thickened during the drawing operation, will eventually be severed from the finished workpiece as scrap. The severed free edge is then appropriately finished in another operation to form the final design contour of a tire bead retaining flange of the finished integral disc and rim segment. In the specific embodiment of the invention illustrated in FIGS. 1–6 of the drawings, the diameter (in flat state) of blank 18 is 24.875", and the radial dimension of the outer margin 36 is 1½".

Figure 2:
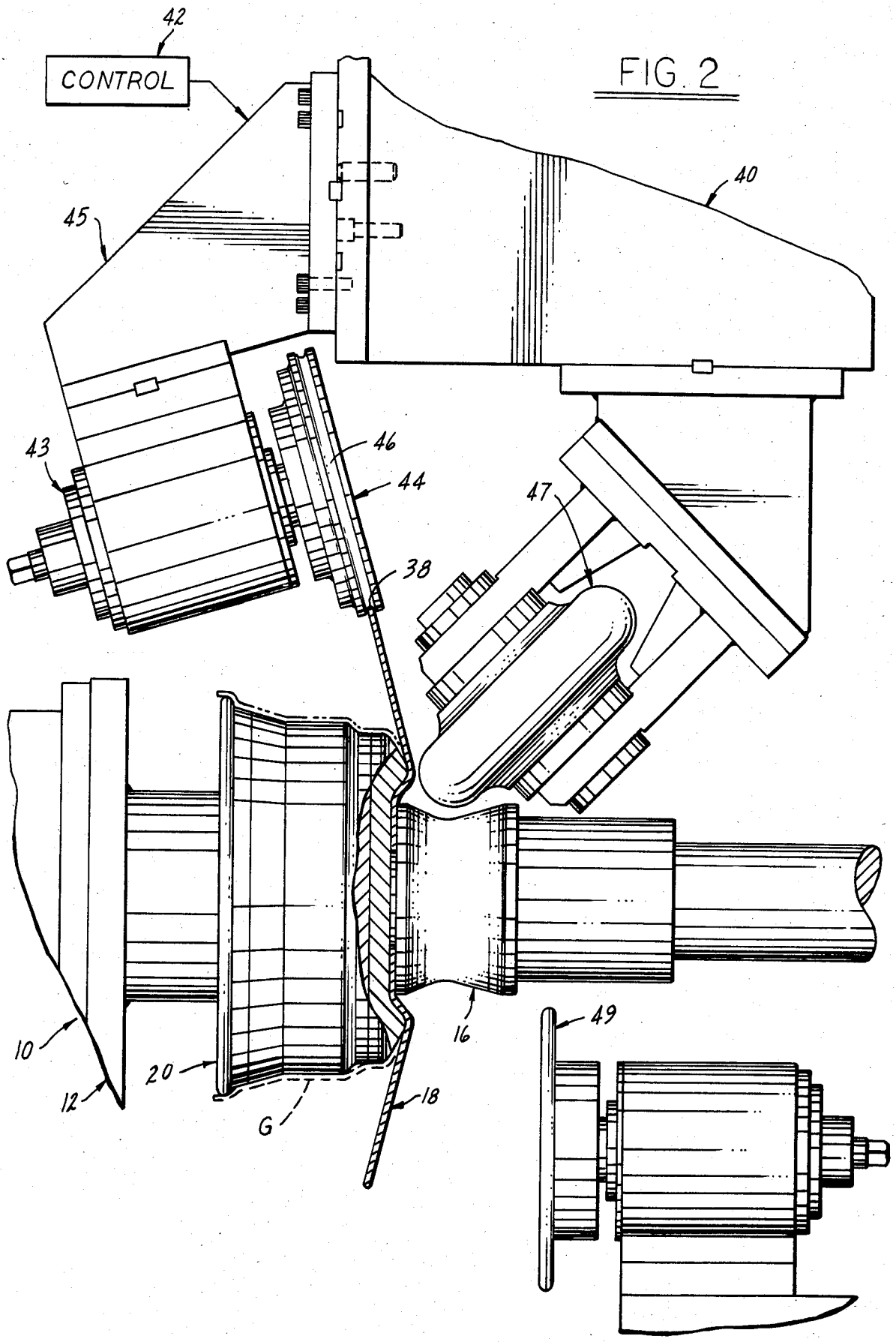
FIG. 2 is a fragmentary plan view of the headstock, mandrel, tailstock and blank of FIG. 1 with an edge conditioning work roller associated with the draw spinning work roller, both mounted on the holder of the tool slide of the spinning machine, shown juxtaposed to the blank upon the edge conditioning roller engaging the same, in accordance with the method and apparatus of the present invention.

Referring to FIG. 2, the overall spinning machine (partially shown) has a conventional tool slide 40 which is operably coupled in the usual manner to a conventional programmable control mechanism indicated schematically at 42 for controlling axial and radial motion of a blank edge conditioning roller 44. Roller 44 is mounted for free rotation about its axis on a journal box 43, which, in turn, is fixed by a bracket 45 secured to tool slide 40. Slide 40 is programmed to cause roller 44 to engage the peripheral edge 38 of blank 18 during rotation of chuck 10 so as to engage and deform peripheral edge 38 in a controlled pre-programmed manner in accordance with the present invention, and prior to engagement of the blank by the draw spinning roller 47 and finishing spinning roller 49 as employed in the method disclosed and claimed in the aforesaid Jurus co-pending application.

Figure 3:
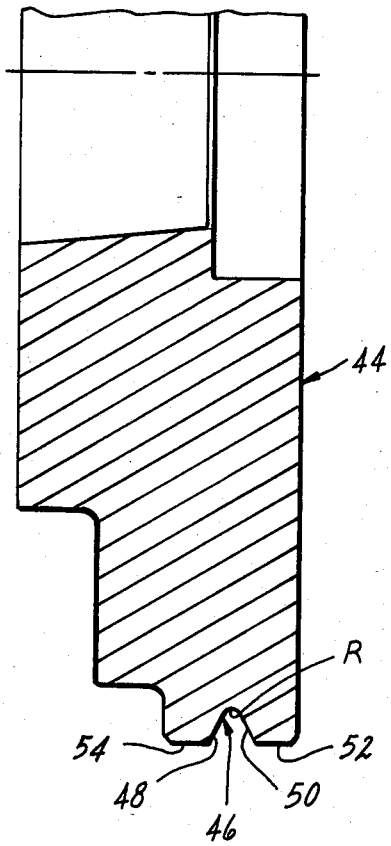
FIG. 3 is a fragmentary axial and radial section of the edge conditioning work roller of FIG. 2 shown by itself.
Figure 4:
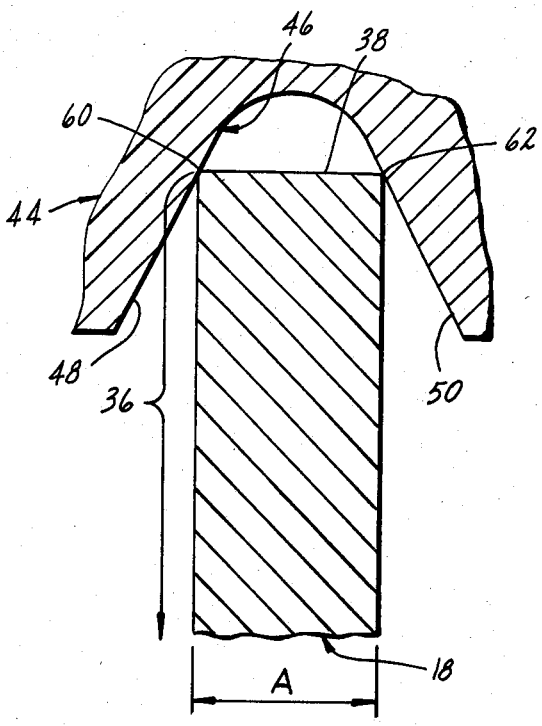
FIG. 4 is a fragmentary center sectional view of the peripheral edge portion of the blank of FIG. 1 after the same has been cut to design size, and illustrating initial contact of the edge conditioning work roller with the blank edge just prior to edge conditioning in accordance with the present invention.
Figure 5:
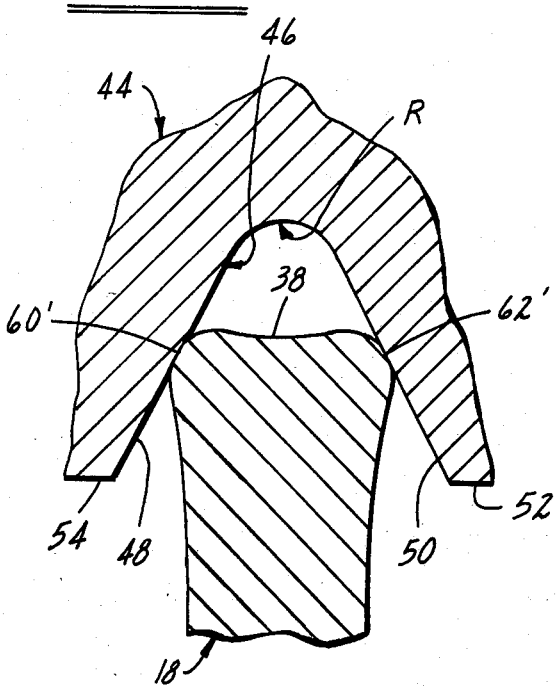
FIG. 5 is a fragmentary radial and axial center section of the blank edge engaged by the edge conditioning work roller during an intermediate stage in processing in accordance with the present invention.
Figure 6:
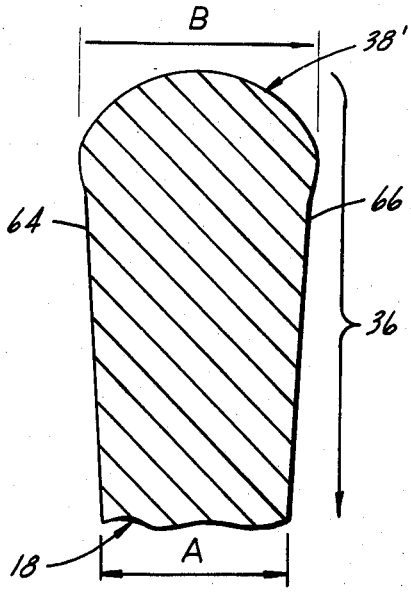
FIG. 6 is a fragmentary radial and axial center section of the blank peripheral edge after completion of edge conditioning thereof in accordance with the present invention and ready for the subsequent draw spinning and spin-forming operations.

As shown in more detail in FIGS. 3 and 5, roller 44 has a continuous circumferentially extending external groove 46 defined by opposed outwardly divergent side walls 48 and 50 which define, in the specific embodiment of FIGS. 1–6, an included angle of 56' therebetween. The root of groove 46 is curved with a constant radius of curvature R which in this specific embodiment is 0.125". The apex of this root curvature is located at a defined radial distance from the cylindrical outer boundary faces 52 and 54 of roller 44, which, in this specific embodiment, is preferably 0.280". Also, in this specific embodiment, roller 44 may have an overall diameter of 5.50" and an overall axial dimension of 2.50".

The method of edge conditioning a workpiece 18 in accordance with the present invention, prior to drawspinning and spin-forming the same in accordance with the aforesaid Jurus application into an integral rim and disc segment, will now be described in greater detail in conjunction with FIGS. 1–6. With blank 18 mounted as previously described in chuck 10, head stock 12 and tail stock 16 are rotated at a relatively low speed (e.g. 90 rpm) by shaft 14. Then edge conditioning roller 44 is advanced in a direction perpendicular to its axis of rotation and in a direction coincident with the mid-plane of boundary regions 36 and 34 of workpiece blank 18 and centered on the root of groove 46, as diagrammatically indicated by the arrow F in FIG. 1. As roller 44 is thus advanced it is brought into controlled engagement with rotating blank 18 such that walls 48 and 50 of groove 46 first engage the right angle edges 60 and 62 of peripheral outer margin portion 36 of blank 18, as shown in FIG. 4. The initial frictional engagement of the blank and roller will cause roller 44 to rotate freely on its tool journal while being rotatably driven by the rotating blank.

The programmed controlled advance of roller 44 is continued to cause progressive interengagement with blank edge corners 60 and 62, roller 44 being forced thereagainst with sufficient pressure to deform the edge corners into a bulging rounded shape. An intermediate stage of this cold working deformation is shown in FIG. 5 wherein sharp edges 60 and 62 have disappeared and have been reformed into rounded bulbous portions 60'and 62'. This deformation also begins to cause an axial thickening of the radially outermost portion of zone 36.

Preferably, and in accordance with another feature of the present invention, advance of roller 44 into workpiece engagement is continued until edge 38 has fully bottomed in the root surface R of roller groove 46. Roller 44 is then withdrawn from engagement with workpiece 18, leaving the outer marginal blank zone 36 which defines the outer periphery of the blank with a cross-sectional contour as shown in cross section in FIG. 6. Note that the initial cylindrical outer edge 38 has disappeared and has been replaced by a spherical outer edge 38' having a uniform radius of curvature slightly larger than that of root R of roller 44, for example 0.141" in the specific embodiment disclosed in FIGS. 1–6. Moreover, margin 36 has been thickened by imparting a radially outwardly divergent taper thereto such that the maximum axial dimension or thickness dimension thereof "B" is greater than the blank starting dimension "A", e.g., B=0.246". The outwardly divergent side walls 64 and 66 of margin 36, after blank edge conditioning, thus converge from dimension "B" in a radially inward direction until the same merge with the blank side walls spaced by the initial starting dimension, which in turn then run parallel radially inwardly for the remainder of zone 36 and as well as in zone 34 spaced apart by the constant thickness dimension "A", e.g., A=0.205".

The aforementioned edge conditioning in accordance with the present invention has been found successful to close up the micro cracks caused by the shearing operations performed in cutting out the initial flat circular starting blank to provide the blank preform 18. Roller 44 upsets the peripheral edge metal to provide a workhardened region at the outer edge of the blank which is substantially harder than the remainder of the blank. For example, in one commercially successful processing in accordance with the invention the blank edge 38' averaged a Rockwell hardness of $R_B=90$, as compared to a Rockwell hardness of $R_B=65$ for the side walls of zone 34. The workhardened marginal area has been found to prevent initiation of stress cracks as well as to reduce propagation of any residual micro cracks during the subsequent draw-spinning and spinforming operations described above.

Additional advantages of the present invention include elimination of certain machining pre-operations and/or reduction in scrap loss. Prior to the present invention, it was customary to perform a machining operation on the workpiece blank 18 to provide a beveled cut-off surface at each of the right-angle edge corners 60 and 62 of the blank in an attempt to limit initiation and propagation of stress cracks during spinning and drawing operations on the blank. Such edge beveling machining operation was performed on a vertical lathe, and in the specific example illustrated herein relative to workpiece 18, required a double tool metal cutting operation to be performed, which, on the average, consumed about ten minutes per blank. By contrast, the edge rolling operation with roller 44 in accordance with the illustrated embodiment of FIGS. 1–6 of the present invention takes only three seconds to complete the cycle of roller advance, blank engagement and roller withdrawal.

In addition, hitherto a relatively large zone 36 of extra material was provided to create an isolation zone wherein edge cracks, if they did propagate, would not propagate into the boundaries of the workpiece when in finished form after cut-off of the isolation margin 36. By contrast, depending upon the configuration and degree of draw-spinning and spinforming to be imparted to the workpiece blank 18 or other analogous articles, it is possible by utilizing the present invention to significantly reduce the radial dimension of the marginal isolation zone 36 because less crack migration isolation is needed once a rounded-off hardened surface 38' has been imparted to the blank as compared to the prior processing. For example, when the principles of the present invention were applied to edge conditioning in accordance with the species of FIG. 7, the isolation zone was reduced by 50% over the aforementioned prior practice. Hence, the amount of material eventually lost as scrap may, in many instances, be greatly reduced, which represents an extra saving cumulative to the reduced cycle time savings.

Another feature of the present invention is the manner in which the edge conditioning roller 44 and associated tooling may be combined with the draw spinning roller 47 and associated tooling on the spinning machine employed to perform the method disclosed and claimed in the aforesaid co-pending Jurus application. As shown in FIG. 2, rollers 44 and 47 may be both fixedly mounted on the same tool slide 40 so as to have a fixed position relative to one another, both rollers being angulated relative to one another and blank preform 18 when chucked as shown in FIG. 2. Note that, when roller 44 has moved inwardly toward chuck 10 in the direction F of FIG. 1 to its final blank engagement travel end limit, roller 47 is still spaced radially outwardly and clear of tailstock 16, and is also spaced clear of the adjacent face of preform 18. Moreover, when roller 47 subsequently moves through its pre-programmed controlled multiple-path motion to draw air spin preform 18 ultimately to the contour shown in broken lines at G in FIG. 2, the travel path of roller 44 (now idle) remains completely clear of preform 18 as the same is progressively draw-spun through its various intermediate contours by the draw air spinning cycle of roller 47. Hence, only one tool slide 40 need be provided for both edge conditioning and draw air spinning, and controller 42 need only have the edge conditioning software added thereto so as to precede the draw spinning control software.

Referring in more detail to the alternate species of the invention illustrated in FIG. 7, a flat circular blank 70 is shown clamped between the head stock 72 and tail stock 74 of a conventional spinning machine provided with the usual spinning rollers (not shown) which form blank 70 against the surface of mandrel 72 to provide the disc of a conventional truck wheel. An example of one such prior art set-up is shown in the aforementioned U.S. Pat. No. 3,143,377 Bulgrin et al. In accordance with the present invention, prior to spinning, an edge conditioning roller 76, having an external circumferentially continuous groove 78 similar to roller 44, is journalled for free rotation on an automatically controlled tool slide 80. The motion of roller 76 is again pre-programmed so as to bring groove 78 into engagement with the outer peripheral edge 82 of blank 70 while the same is rotating on the spinning machine to thereby upset the peripheral edge and work harden the same in a manner similar to that described in conjunction with the edge conditioning of blank 18 in FIGS. 1–6. The aforementioned advantages in reduced machining tooling and cycle time, as well as reduced scrap loss, may thereby be imparted to conventional truck disc spinning operations.

The principles of the invention can also be applied to another form of preformed workpiece blank, as illustrated in FIG. 8. In this example, a cylindrical blank preform is provided as a starting workpiece 100 and the same is mounted on the chuck 102 of a conventional vertical lathe for rotation about the vertical rotational axis 103 of the chuck and workpiece. An edge conditioning roller 104, similar to rollers 44 and 76, is journalled for free rotation on a program-controlled work slide 105. Roller 44 has an external circumferentially continuous groove 106 in the periphery of the roller which is brought into engagement with the peripheral edge 108 of the rotating blank 100 to upset and deform the cylindrical upward edge 108 of blank 100 in accordance with the process and apparatus principles described previously in the foregoing examples of FIGS. 1–7. The edge-conditioned blank is then ready for processing through the usual permanent deformation steps into a finished workpiece, e.g., inner rim of a 20" diameter×10" wide wheel. Again, edge crack migration is thereby substantially eliminated, less marginal isolation scrap material is needed, and the prior edge machining operations are eliminated.

It will also be noted that in all of the foregoing embodiments of the invention the edge conditioning and work hardening of the blank in accordance with the present invention does not adversely affect the final cut-off and/or finishing operations normally performed on the workpiece since such cutting and/or finishing is made in a softer zone of the outer marginal isolation material which has not been work hardened by the edge conditioning upsetting operation.

I claim:

1. A method of forming an annular article from a circular blank workpiece comprising the steps of:

(a) clamping said blank in a rotatable chuck such that a peripheral portion of said blank is spaced from said chuck;

(b) causing said chuck to rotate said workpiece about an axis of revolution thereof;

(c) while said workpiece is being so rotated, cold work edge conditioning said peripheral blank portion by engagement with an edge conditioning roller with sufficient force and cycle time to impart an upset condition thereto and wherein an edge surface of said peripheral portion engaged by said roller is smoothed and hardened to a given rounded curvature in radial cross section thereto and controlled thickness increase is obtained in said peripheral blank portion; and (d) then further processing said workpiece through a permanent deformation cold working to change the contour of said workpiece in a zone of said peripheral blank portion adjacent said upset edge portion of said workpiece blank.

2. The method set forth in claim 1 wherein said step (c) is carried out by engaging said edge conditioning roller against said peripheral blank portion in a single pass, said roller having an external circumferential groove with an entrance wider axially of said roller than the starting axial dimension of said peripheral portion of said blank, and wherein said roller is moved in a direction perpendicular to its rotational axis with said roller groove centered on said blank edge.

3. The method set forth in claim 2 wherein said thickness increase and edge upsetting is so controlled as to obtain substantially uniformly increasing thickness radially outwardly of said blank peripheral portion with the maximum thickness occurring at said rounded curvature edge surface.

4. The method set forth in claim 3 wherein said blank edge engaging groove of said edge conditioning roller has a rounded root surface with a radius of curvature smaller than the axial starting thickness of the engaged edge of said blank, and wherein said step (c) is carried out by engaging said blank peripheral portion with said edge conditioning roller until said controlled thickness increase is obtained and said upset peripheral portion bottoms in said roller groove.

5. The method set forth in claim 4 wherein said chuck has a mandrel surface with a surface contour corresponding to the final desired contour of said annular article, and wherein said step of said method comprises:

spin forming said major portion of said blank peripheral portion against said surface to obtain said final desired contour while maintaining said peripheral blank portion at a substantially uniform thickness.

6. A method of forming a one-piece vehicle wheel disc and rim segment which includes disc and rim portions of preselected cross sectional geometry and thickness contours, said method comprising the steps of:

(a) providing a wheel spinning chuck which includes a mandrel having an exterior surface which corresponds to said preselected geometry contour;

(b) providing a workpiece circular blank having a central portion with a thickness contour equal to said preselected thickness contour of said disc portion and a peripheral portion with a thickness contour that is greater than said preselected thickness contour of said rim portion;

(c) clamping the central portion of said blank in said chuck with said blank peripheral portion being spaced axially and radially from said mandrel surface;

(d) causing said chuck to rotate said workpiece about an axis of revolution thereof;

(e) edge conditioning said peripheral blank portion by engagement with an edge conditioning roller while the workpiece is being so rotated and said peripheral portion remains spaced from and unsupported by said chuck so as to obtain controlled thickness increase in said peripheral blank portion and to impart an upset condition thereto such that the edge surface of said peripheral portion is smoothed and hardened to a given rounded curvature in radial cross section;

(f) thereafter draw-spinning said peripheral blank portion with a first spinning roller with said blank peripheral portion being spaced from said surface so as to reduce the thickness contour of said peripheral portion to said preselected thickness contour; and then (g) spin-forming said peripheral blank portion with a second roller against said surface without substantially altering the thickness of thereof so as to obtain said preselected geometry contour.

7. The method set forth in claim 6 wherein said edge conditioning roller has a blank edge engaging groove with a rounded root surface having a radius of curvature smaller than the axial starting thickness of the engaged edge of said blank, and wherein said step (e) is carried out by engaging said blank peripheral portion with said edge conditioning roller until said thickness increase is obtained and said upset peripheral portion bottoms in said roller groove.

8. The method set forth in claim 1 wherein said steps (e) and (f) comprise forming said blank periphery to possess substantially uniform thickness throughout the major portion thereof, with the peripheral edge of said blank being thicker than said major portion, and wherein said method comprises the additional step of:

(h) removing said peripheral edge from said blank.

9. The method set forth in claim 8 wherein said step (a) includes the step of providing a said disc blank of substantially uniform thickness and constructed of HSLA steel composition.

10. Apparatus for forming an annular article from a circular blank comprising:

(a) means for clamping said blank in a rotatable chuck such that a peripheral portion of said blank is spaced from said chuck;

(b) means for causing said chuck to rotate said workpiece about an axis of revolution thereof;

(c) means for cold work edge conditioning said peripheral blank portion while said workpiece is being so rotated comprising a roller engageable with said blank peripheral portion with sufficient force and for a sufficient cycle time to impart an upset condition and a controlled thickness increase thereto, said roller having a work surface configured to impart to an edge surface of said peripheral portion engaged by said roller a smooth, hardened and rounded curvature in radial cross section, and (d) means for further processing said workpiece through a permanent deformation cold working to change the contour of said workpiece in a zone of said peripheral blank portion adjacent said upset edge portion of said workpiece blank.

11. The apparatus set forth in claim 10 wherein said roller work surface comprises an external circumferential groove with an entrance wider axially of said roller than the starting axial dimension of said peripheral portion of said blank, and wherein said edge conditioning means is operable to move said roller in a direction perpendicular to its rotational axis with said roller groove centered on said blank edge.

12. The apparatus set forth in claim 10 wherein said edge conditioning means is operably controlled relative to said blank to produce substantially uniformly increasing thickness radially outwardly of said blank peripheral portion with the maximum thickness occurring at said rounded curvature edge surface.

13. The apparatus set forth in claim 10 wherein said edge conditioning roller has a blank edge engaging groove with a rounded root surface having a radius of curvature smaller than the axial starting thickness of the engaged edge of said blank, and wherein said edge conditioning means is operable to cause said blank peripheral portion to engage said edge conditioning roller until said controlled thickness increase is obtained and said upset peripheral portion bottoms in said roller groove.

14. Apparatus for forming a one-piece vehicle wheel disc and rim segment which includes disc and rim portions of preselected cross sectional geometry and thickness contours, utilizing a workpiece starting blank consisting of a circular blank having a central portion with a thickness contour equal to said preselected thickness contour of said disc portion and a peripheral portion with a thickness contour that is greater than said preselected thickness contour of said rim portion, said apparatus comprising:

(a) a wheel spinning chuck which includes a mandrel having an exterior surface which corresponds to said preselected geometry contour and means for clamping the central portion of said blank in said chuck with said blank peripheral portion being spaced axially and radially from said mandrel surface;

(b) means for causing said chuck to rotate said workpiece about an axis of revolution thereof;

(c) means for edge conditioning said peripheral blank portion including a roller engageable with said blank peripheral portion while the blank is being so rotated and said peripheral portion remains spaced from and unsupported by said chuck and operable so as to obtain controlled thickness increase in said peripheral blank portion and to impart an upset condition thereto such that the edge surface of said peripheral portion is smoothed and hardened to a given rounded curvature in radial cross section;

(d) means for thereafter draw-spinning said peripheral blank portion comprising a first spinning roller operably engageable with a non-edge conditioned portion of said blank peripheral portion while the same is spaced from said surface so as to reduce the thickness contour of said peripheral portion to said preselected thickness contour;

(e) means for spin-forming said peripheral blank portion comprising a second roller operably engageable against said surface without substantially altering the thickness of thereof so as to obtain said preselected geometry contour, and (f) roller support means comprising a common tool slide carrying said edge conditioning roller and said first spinning roller juxtaposed relative to one another and the starting position of said blank when so chucked such that said edge conditioning and first spinning rollers have mutually non-interferring travel paths relative to said blank throughout the respective work cycle motions of said rollers.

* * * * *